US006185788B1

(12) United States Patent
Patelli et al.

(10) Patent No.: US 6,185,788 B1
(45) Date of Patent: Feb. 13, 2001

(54) DEVICE AND METHOD FOR DISCHARGE AND CLEANING OF THE WEB AT THE OUTPUT OF A CARDER

(75) Inventors: Silvano Patelli; Giovanni Battista Pasini, both of Palazzolo Sull'oglio (IT)

(73) Assignee: Marzoli S.p.A., Palazzolo Sull'oglio (IT)

( * ) Notice: Under 35 U.S.C. 154(b), the term of this patent shall be extended for 0 days.

(21) Appl. No.: 09/478,404

(22) Filed: Jan. 6, 2000

(30) Foreign Application Priority Data

Jan. 14, 1999 (IT) ..... MI99A0055

(51) Int. Cl.[7] ..... D01G 15/76
(52) U.S. Cl. ..... 19/107; 19/98; 19/106 R
(58) Field of Search ..... 19/98, 99, 106 R, 19/107, 108, 109, 150, 152, 153, 296

(56) References Cited

U.S. PATENT DOCUMENTS 3,235,911 * 2/1966 Reiterer ..... 19/106 R
4,221,022 * 9/1980 Iida ..... 19/106 R
4,274,178 * 6/1981 Hotta ..... 19/106 R
4,299,011 * 11/1981 Rothen et al. ..... 19/106 R
4,332,058 * 6/1982 Warnock ..... 19/106 R
4,352,223 * 10/1982 Felix et al. ..... 19/106 R
4,374,448 * 2/1983 Loffler ..... 19/106 R
5,522,119 * 6/1996 Leifeld et al. ..... 19/106 R

OTHER PUBLICATIONS

U.S. Ser. No. 09/579,132, filed Jan. 6, 2000, pending.
U.S. Ser. No. 09/579,132, filed May 30, 2000, pending.

* cited by examiner

*Primary Examiner*—John J. Calvert
*Assistant Examiner*—Gary L. Welch
(74) *Attorney, Agent, or Firm*—Oblon, Spivak, McClelland, Maier & Neustadt, P.C.

(57) ABSTRACT

Method and device for discharge and cleaning of the web produced by a carder, by the effect of suction applied to the web, in its passage from the detachment cylinder to the web-presser cylinders, preferably combined with drawing of the web in this section, by the effect of actuation of the web-presser cylinders, at a linear speed which is higher than that of the detachment cylinder.

14 Claims, 4 Drawing Sheets

DEVICE AND METHOD FOR DISCHARGE AND CLEANING OF THE WEB AT THE OUTPUT OF A CARDER

The present invention relates to machines for carding of textile fibres, in which the flock fibres are worked in order to produce a web of fibres. In this operation, the short fibres and tangles are removed from the fibres, which are stretched and rendered parallel in a web of fibres which is disposed on the covering of the drum of the carder, from which the web of fibres is collected by means of a rotary detachment cylinder, correctly known as a doffer, which is provided with a suitable covering, and is then passed from a subsequent detachment cylinder to a compactor unit and to a drawing unit, in order to produce a strip of fibres.

More particularly, the present invention relates to a method and a device, in which the web which has been detached from the carder by the doffer is then collected by the detachment cylinder, and is supplied downstream to a unit for compacting of the web into a strip, and controlled drawing.

In order to make more apparent the technical aspects and the problems involved in carding, reference is made to a drawing of the sequence of the carder drum, the doffer, the detachment cylinder and the compactor, illustrated in FIG. 1, in a schematic lateral view.

Downstream from the main drum of the carder 1, the doffer of the carder is indicated as 2, and on the latter the web of fibres 3 is brought to the detachment cylinder 4, and is conveyed to the compactor unit, consisting of a pair of smooth, rotary web-presser cylinders 5, 6 with a substantially horizontal axis, which compact the web 3, which still has a transverse dimension corresponding to that of the carder, and transfer the web to a subsequent belt conveyor 7 with a vertical work surface, which compacts the web into a strip. The compactor unit operates at a speed which is compatible with that of the web 3 obtained from the detachment cylinder 4. The two web-presser cylinders 5 and 6 are rotated at a linear speed which is the same as one another, thus preventing friction against one another. The drawn strip is then conveyed for collection in a container, for subsequent processing operations. Above the detachment cylinder 4, there is disposed a device for cleaning the covering of the latter, consisting of a rotary brush 8.

The diagram described hitherto substantially concentrates all the work on the web of fibres on the covered surfaces of the main carder drum 1, and of the supply cylinder or briseur which proceeds this drum, and is not shown in FIG. 1 for the sake of simplicity.

The carding action consists of stretching the fibres and rendering them parallel, and removing from them impurities which cannot be woven, which are commonly known as trash, by the effect of opposition of the covered surfaces of the briseur and of the carder drum 1, which rotate at a high speed, relative to the coverings of the mobile crossheads and other fixed components, such as separator blades, carding plates, and suction nozzles. These cleaning means operate on the entire generatrix of these drums, which corresponds to the width of the web 3. The various drums and cylinders of the carder are enclosed in retention plates which are suitably connected and are commonly known as guards or "aprons", in order to restrain the fibres and convey them, making them continue to adhere to the tips of the coverings of the said cylinders. The said restraint is interrupted only at the cleaning means, in order to permit controlled removal of the impurities extracted from the fibres.

When the web of fibres leaves the surface of the carder drum 1, as a result of the action of the doffer 2, there is no longer any substantial action of cleaning of the web. In the web thus produced, there remain substantial quantities of small impurities, known as micro-impurities or micro-particles, which are the most difficult to separate since they are buried in the innermost layer of the web of fibres on the covered drums, and are protected against the action of the fixed cleaning components.

These residual micro-impurities thus remain in the web, and therefore in the strip, and finally in the yarn produced, in which they are clearly visible, and detract from the quality of the product. In the operations of dyeing the yarn, the presence of the micro-particles is very detrimental in terms of local variation of absorption of the dye, and provides a product with a colour which is not regular, and generally is not well accepted.

The object of the present invention is to carry out discharge and cleaning of the web of fibres produced by a carder, with control and reduction of the content of these micro-impurities.

The present invention consists of a device and a method for discharge and cleaning of the web produced by a carder. The salient characteristics of the device for discharge and cleaning are defined as well as its preferred embodiments. The salient characteristics of the method are defined as well as its preferred embodiments.

The invention is described hereinafter with reference to typical embodiments illustrated in FIGS. 2 to 4, by way of non-limiting example, and for the purpose of making more apparent the characteristics and advantages of the present invention with reference to the attached schematic drawings, in which.

Figure 1:
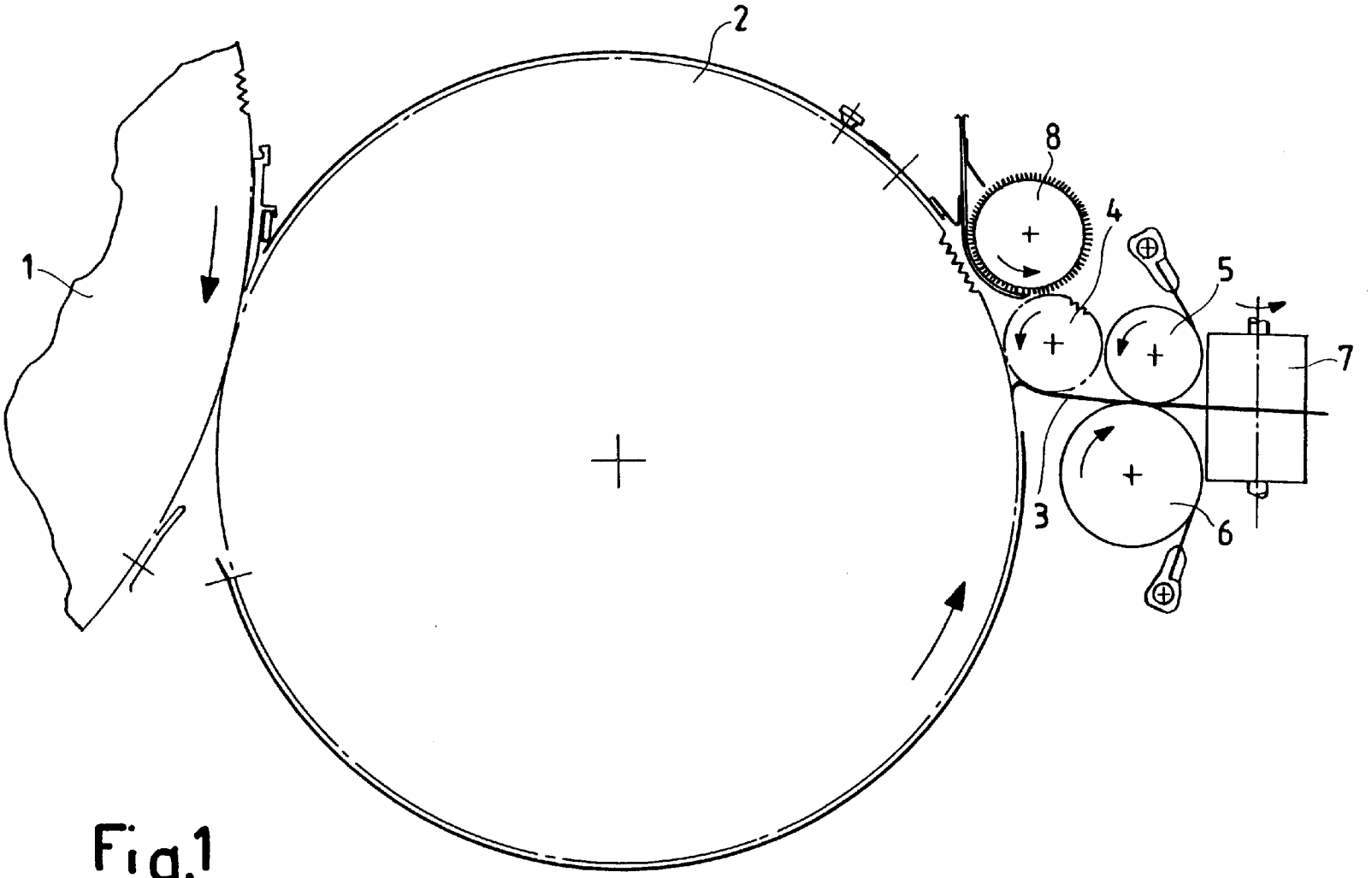
Fig.1 PRIOR ART
FIG. 1 illustrates the technical problem in general.
Figure 2:
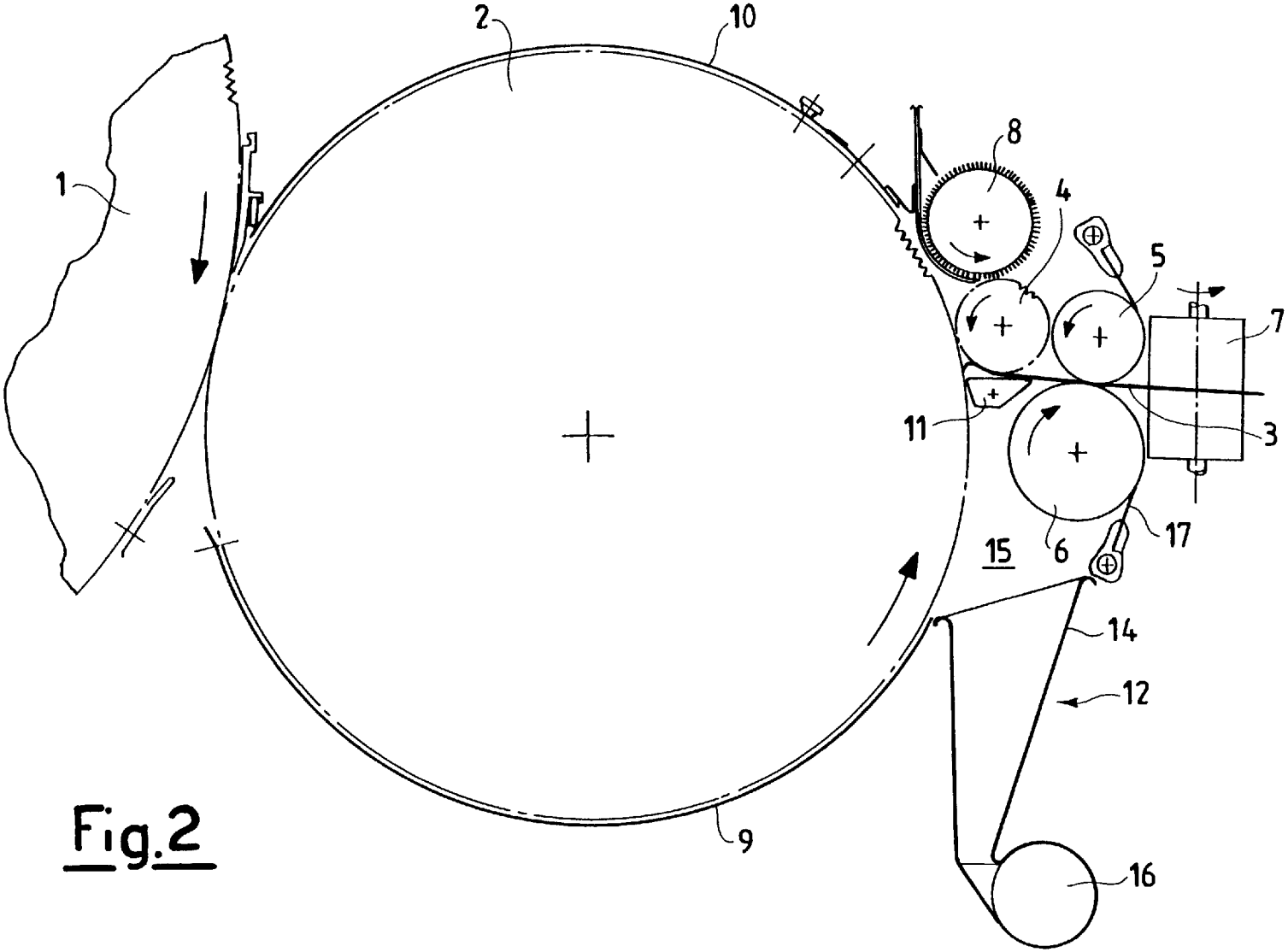
FIG. 2 is a diagram of the unit according to the invention, for discharge and cleaning of the web.

FIG. 2 shows an embodiment of the invention in which the operation of collection of the web 3 which is disposed on the covered surface of the doffer 2 is carried out by means of the detachment cylinder 4, which is also covered with tips, and rotates in a direction contrary to that of the doffer 2. In general, the doffer 2 is rotated at a linear steady state speed of between 50 and 200 m/min, whereas the detachment cylinder 4 works at a speed of the same order of magnitude. The doffer 2 is contained within two, respectively lower and upper guards 9 and 10.

Beneath the detachment cylinder 4, there is disposed a transverse bar 11, which supports the web 3 detached by the cylinder 4. The upper surface of this bar is flat and smooth, such that it does not impede passage of the web which is detached from the detachment cylinder 4. In general, the bar is fitted at a distance of between 1 and 5 mm from the rotary tips of the detachment cylinder 4.

Below the detachment cylinder 4, the bar 11, and the lower web-presser cylinder 6, there is disposed a suction unit 12, comprising a funnel-shaped connection 14, which is as wide as the generatrix of the doffer 2, and connects the space 15 beneath the web 3, which goes from the bar 11 to the web-presser cylinders 5, 6 to a suction duct 16, which is connected to the general suction service for the carder.

The space 15 is also enclosed by means of the elastomer plates which are pressed resiliently, and are kept continually adhering to the web-presser cylinders along their entire length, and in particular by the plate 17, which is disposed such that it adheres tangentially to the lower web-presser cylinder 6. In the embodiment shown in FIG. 2, the lower guard 9 of the doffer 2 is interrupted at its meeting point with the funnel 14, such that the surface of the doffer also is subjected to the action of suction towards the duct 16, in the section between the funnel 14 and the bar 11.

Figure 3:
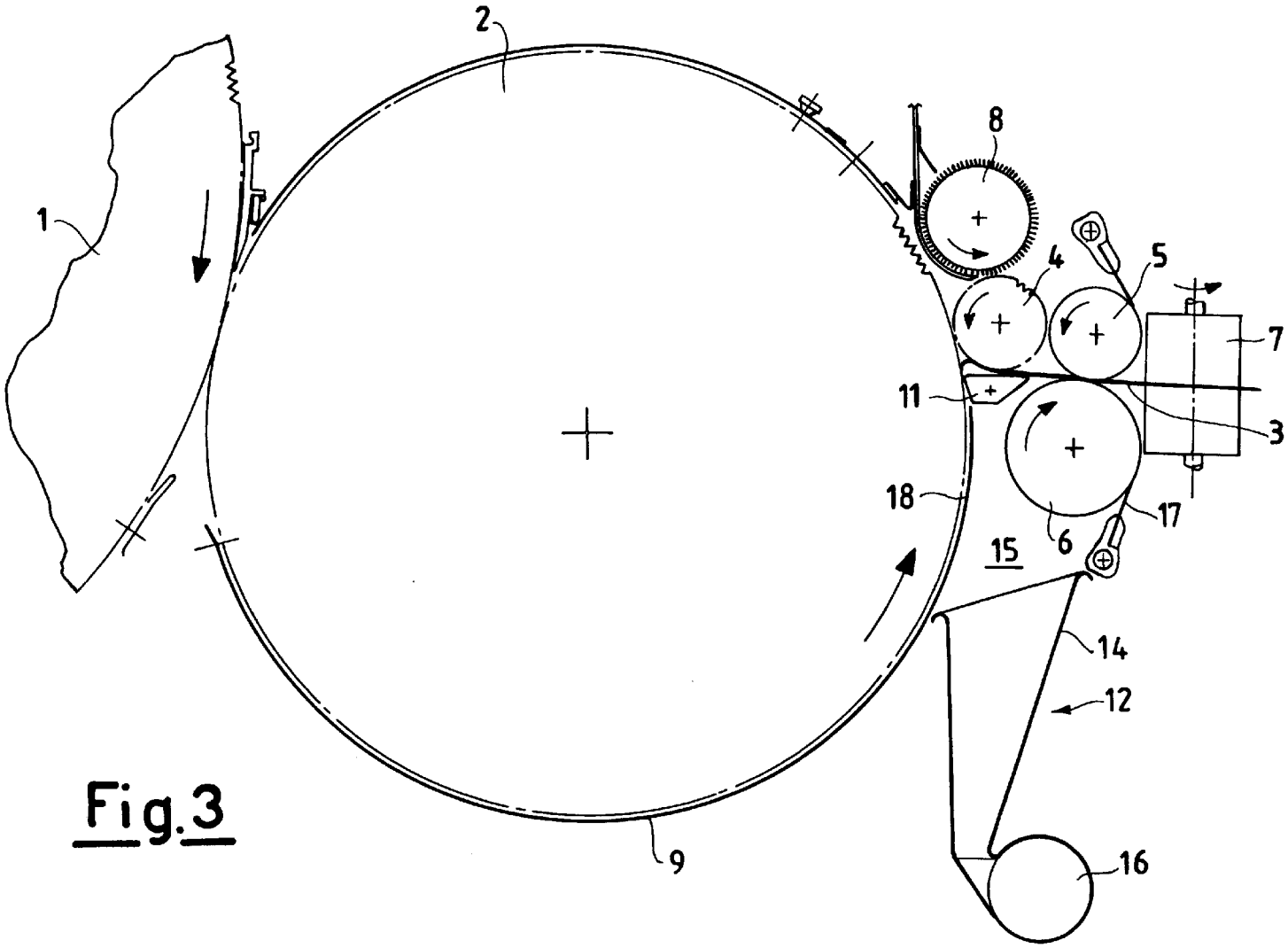
FIG. 3 is a variant of this drawing.

In the embodiment shown in FIG. 3, which constitutes an alternative to the case in FIG. 2, the lower guard 9 of the doffer 2 is not interrupted at its meeting point with the funnel 14, but is continued by a further guard 18. By this means, the surface of the doffer is not subjected directly to any action of suction towards the duct 16, in the section between the funnel 14 and the bar 11.

The treatment of cleaning of the web 3 as it is discharged from the detachment cylinder 4, is substantially carried out as the web passes from the detachment cylinder itself to the two web-presser cylinders 5 and 6, which immediately follow the latter. In particular, the upper web-presser cylinder 5 is positioned quite close to the detachment cylinder 4, but between the two, there is a significant difference which leaves a gap, inside which there flows most of the air drawn by suction towards the duct 16. In general, this distance between the detachment cylinder 4 and the upper web-presser cylinder 5 is quite small, and is maintained as approximately 1 mm or even less, such that the flow of air drawn by means of the suction also assists the operation of detachment of the web from the detachment cylinder.

Figure 4:
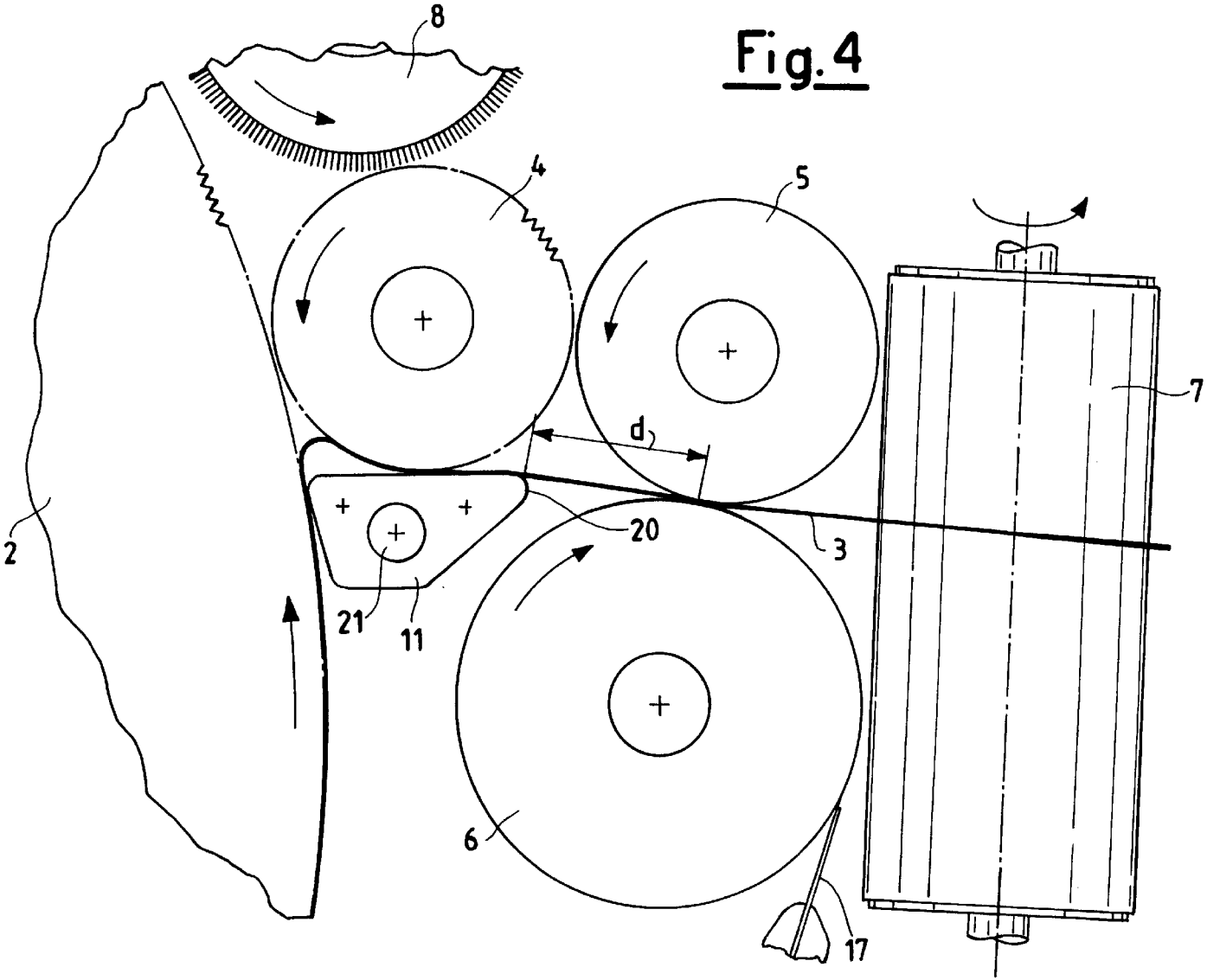
FIG. 4 is an enlarged detail of the detachment cylinder and of the web-presser cylinders.

FIG. 4 shows in greater detail the discharge unit of the carder, between the detachment cylinder 4 and the two web-presser cylinders.

In general, the lower web-presser cylinder 6 is positioned slightly further upstream than the lower web-presser cylinder 5, such that the web 3, which passes from left to right, is supported firstly on the cylinder 6, and is then gripped by the cylinder 5 opposite the latter.

The air which is sucked towards the duct 16 is substantially regulated on the basis of the suction pressure value which is established in the duct. In general, this suction pressure value is in the interval of 30 to 40 mm of water column.

Most of the flow of air towards the duct 16 caused by suction, is drawn into the gap between the detachment cylinder 4 and the web-presser roller 5, and is forced to cross through the web 3, which passes between the detachment cylinder and the compactor unit. In the free section of the web between these units, there is exerted efficient action of removal of the micro-particles, which are released and fall downwards, both as a result of their own weight, and of the suction action.

According to a preferred embodiment of the device according to the invention, the bar 11 has a cross-section in the shape of an inverted trapezium, as shown in FIGS. 2–4, such as to provide at the web, a contracted cross-section and a higher speed of flow of air through the web.

The distance d between the lip 20 of the bar 11 in FIG. 4, and the point of gripping of the web between the two web-presser cylinders, is in the interval of 10 to 70 mm, and is preferably between 30 and 55 mm. This distance can be selected or regulated on the basis of the type of fibres to be worked, and in general is easily modified by varying the angular position of the bar 11, providing the latter with angular regulation means in order to vary the inclination of the surface of passage of the web on the bar, or by replacing the bar with another bar 11, with a different shape.

In order to vary its angular position, the bar 11 is for example pivoted on a pin 21, is rotated slightly around the latter, and is then secured with screws and nuts through adjustment slots which are not explicitly shown in the Figure, for the sake of simplicity.

According to a preferred embodiment of the method according to the invention, the action of removal of the micro-particles from the web is carried out by actuating the two web-presser cylinders 5 and 6 at a linear speed which is slightly higher than that of yielding by the detachment cylinder 4, such as to exert a moderate action of drawing of the web, between the detachment cylinder 4 and the cylinders 5, 6, in the free section of the web. In general, this drawing action is carried out with drawing values of between 1.2 and 1.4. For this purpose, the pair of web-presser cylinders 5, 6 has means for rotation, in order to provide the cylinders with a controlled linear speed, and which in particular is higher than that of the detachment cylinder 4.

This moderate action of drawing of the web in its free section between the detachment cylinder 4 and the web-presser cylinders 5, 6 gives rise to significant sliding between the individual fibres which are contained in the web 3, thus moving these fibres and assisting release of the micro-particles which are embedded between them, and making these micro-particles more available to the action of transverse suction by the air which is drawn towards the funnel 14.

In the embodiment in FIG. 2, the action of suction of the micro-particles already takes place on the web of fibres held by the covering of the doffer 2, which is conveyed towards the detachment cylinder, in the uncovered section of the web, and in association with the centrifugal effect on the heaviest particles, combined with the tangential flow of air caused by the suction. However, this action is also exerted on the fibres of the web, giving rise to a specific loss of fibres; the embodiments in FIGS. 2 and 3 should therefore be selected as a matter of preference according to the morphological characteristics of the fibres being worked, their content of micro-particles, and the required quality.

The method and the device according to the present invention permit significant progress in comparison with the known art, and at least the following aspects deserve specific consideration.

The operation of cleaning of the web as it is discharged from the detachment cylinder makes it possible to eliminate a further significant quantity of the content of micro-impurities of the web, and to improve the quality and the dyeing characteristics of the yarn produced from the web. The highest values are obtained by combining the effects of drawing of the web, and suction.

The operation of drawing of the web before it is compacted into a strip also makes it possible to increase the overall drawing of the strip downstream, or to reduce the work by the subsequent drawing unit on the strip. This makes it possible to increase the production of the machine, and to divide up the drawing with greater gradualness and overall regularity, for the same characteristics of the worked fibres and product required.

What is claimed is:

1. A device for discharge and cleaning of a web produced by a carder, which is collected from a covered surface of a doffer by a detachment cylinder, and conveyed to a compactor unit including a pair of web-presser cylinders, said device comprising:

a bar disposed beneath said detachment cylinder to support said web; and a suction unit, which connects a space beneath said web to a suction duct.

2. The device according to claim 1, wherein each of said pair of web-presser cylinders comprises a device configured to rotate said pair of web-presser cylinders with a controlled linear speed, which is higher than a linear speed of said detachment cylinder.

3. The device according to claim 1, wherein said suction unit comprises a funnel-shaped connection, which connects said space beneath said web, from said bar to said web-presser cylinders, to said suction duct which is connected to a general suction service for said carder.

4. The device according to claim 1, wherein said space is enclosed in an area of a lower web-presser cylinder of said pair of web-presser cylinders, by a plate, which is disposed such that said plate adheres tangentially to said lower web-presser cylinder.

5. The device according to claim 1, further comprising a lower guard covering a lower portion of said doffer, wherein said lower guard extends over said lower portion of said doffer only up to a meeting point with said funnel.

6. The device according to claim 1, wherein at said meeting point of said lower guard and said funnel, said lower guard of said doffer is continued by a further guard section in a direction of rotation of said doffer.

7. The device according to claim 1, wherein said bar has a cross-section in a shape of an inverted trapezium.

8. The device according to claim 1, wherein said bar includes an angular adjustment device configured to adjust an angle of inclination of a surface of movement of said web on said bar.

9. A method for discharge and cleaning of a web produced by a carder, collected by a covered surface of a doffer by a detachment cylinder, and conveyed to a compactor unit consisting of a pair of web-presser cylinders, said method comprising the steps of:

cleaning a passage of said web from said detachment cylinder to said pair of web-presser cylinders, under action of flow of air towards a duct, which is drawn into a gap between said detachment cylinder and a web-presser roller, and passes through said web.

10. The method according to claim 9, further comprising removing micro-particles from said web, including exerting action of drawing said web, in a section of said web between said detachment cylinder and said web-presser cylinders.

11. The method according to claim 10, wherein said action of drawing includes drawing values of between 1.2 and 1.4.

12. The method according to claim 9, further comprising regulating a suction pressure value in said duct in an interval between 30 and 40 mm of water column.

13. The method according to claim 9, further comprising setting a distance d between a lip of said bar and a point of gripping of said web between said pair of web-presser cylinders to be an interval between 10 and 70 mm.

14. The method according of claim 13, further comprising setting said distance to be an interval between 30 and 55 mm.

* * * * *